US005945891A

United States Patent [19]

Emrick et al.

[11] Patent Number: 5,945,891

[45] Date of Patent: Aug. 31, 1999

[54] MOLDED WAVEGUIDE FEED AND METHOD FOR MANUFACTURING SAME

[75] Inventors: Rudy Michael Emrick, Gilbert; Ronald Dee Fuller; Wade Norman Understiller, both of Mesa, all of Ariz.

[73] Assignee: Motorola, Inc., Schaumburg, Ill.

[21] Appl. No.: 09/032,889

[22] Filed: Mar. 2, 1998

[51] Int. Cl.[6] ..... H01P 5/10

[52] U.S. Cl. ..... 333/26; 333/248; 343/786

[58] Field of Search ..... 333/26, 248, 254; 343/786, 789

[56] References Cited

U.S. PATENT DOCUMENTS

| | | | |
|---|---|---|---|
| 3,707,647 | 12/1972 | Rawls, Jr. | 333/26 X |
| 4,349,790 | 9/1982 | Landry | 333/26 X |
| 4,453,142 | 6/1984 | Murphy | 333/26 |
| 5,045,820 | 9/1991 | Leicht et al. | 333/26 |

FOREIGN PATENT DOCUMENTS

| | | | |
|---|---|---|---|
| 1376138 | 2/1988 | U.S.S.R. | 333/26 |

*Primary Examiner*—Paul Gensler
*Attorney, Agent, or Firm*—Frank J. Bogacz; John C. Scott

[57] ABSTRACT

A waveguide feed is fabricated by first creating a lead frame (10) from a piece of conductive material. The lead frame (10) is shaped by bending arms (22) and probe portions (18) on the lead frame (10) into a desired shape. The lead frame (10) is then placed in a mold and dielectric molding material is added around relevant portions of the lead frame (10). After the dielectric molding material has solidified, excess molding material and extraneous portions of the lead frame (10) are removed from the molded feed assembly. The assembly can then be connectorized and inserted into a waveguide.

9 Claims, 3 Drawing Sheets

MOLDED WAVEGUIDE FEED AND METHOD FOR MANUFACTURING SAME

CROSS-REFERENCE TO RELATED CASES

The present Application is related to co-pending U.S. patent application Ser. No. 08/831,118 assigned to the same assignee as the present Application.

FIELD OF THE INVENTION

The present invention relates generally to electromagnetic radiating elements and, more specifically, to the manufacture of low cost radiating elements.

BACKGROUND OF THE INVENTION

A waveguide is a transmission medium for use in transferring radio frequency signals from a first location to a second, different location. Waveguides generally comprise a hollow pipe having conductive side walls that confine an electromagnetic signal to an internal area during transmission. Signals are coupled into and out of the waveguide (i.e., through the conductive walls) using transitions known as waveguide feeds. Waveguide feeds generally include one or more waveguide probes for launching energy into and sensing energy from the waveguide and some means for coupling electromagnetic energy to/from an external transmission line, such as a coaxial cable.

Known waveguide feeds are invariably manufactured using an assortment of different etched and/or machined parts that need to be soldered together by hand. The assembly process is a relatively complicated process and precision is required if a properly matched feed is to result. In some applications, such as phased array antenna applications, hundreds or even thousands of waveguide feeds may be required to complete a particular design. Consequently, a complicated waveguide feed assembly process can increase the assembly time of the end-product considerably and significantly add to the overall cost.

Therefore, there is a need for a waveguide feed, and other radiating elements, that is relatively simple and inexpensive to manufacture. In addition, there is a need for a method of manufacturing waveguide feeds, and other radiating elements, that is easy, reliable, and supports high volume production.

DETAILED DESCRIPTION OF THE DRAWINGS

The present invention relates to a waveguide feed that is relatively simple and inexpensive to manufacture. A lead frame is first formed that includes, among other things, one or more probes for the feed. The lead frame is shaped, such as by bending with an appropriate tool, into a desired shape. The shaped lead frame is then fit into a mold and a molding material is poured or injected into the mold to form a dielectric mass around the probes, etc. The dielectric mass retains the probes and other elements in the desired shape for performing the transition function. Connectors can then be applied to the feed for connecting the feed to an exterior transmission line or other signal source/sink. The connectorized feed is then inserted into a waveguide for use in coupling energy into/out of the waveguide.

The waveguide feed of the present invention is extremely inexpensive to manufacture compared to feeds of the past having comparable performance. In some cases, assembly costs can be reduced by an order of magnitude or more. In addition, the feed is very simple to assemble (it has a very low part count) and is very conducive to automated mass assembly. The feed can be interfaced with virtually any type of external transmission line, such as, for example, coaxial cable, coplanar waveguide, stripline, microstripline, and others. In addition, the feed can act as a transition into virtually any type of enclosed waveguiding or resonating structure, such as a rectangular or circular waveguide or a resonant cavity apparatus. Alternatively, the feed can operate as a radiating element into free space and, therefore, is not limited to use with enclosed structures. For example, the feed can launch waves into an open ended waveguide or waveguide horn to radiate into free space. The waveguide feed is a relatively compact and rugged unit that will not generally become "untuned" if large shock forces are applied. In addition, consistent performance results can be achieved using the techniques of the present invention with no tuning being necessary during manufacture. Further, the probes of the waveguide feed can be designed to transmit or receive signals having virtually any type of polarization, including linear polarization, left-hand circular polarization, and right-hand circular polarization.

Figure 1:
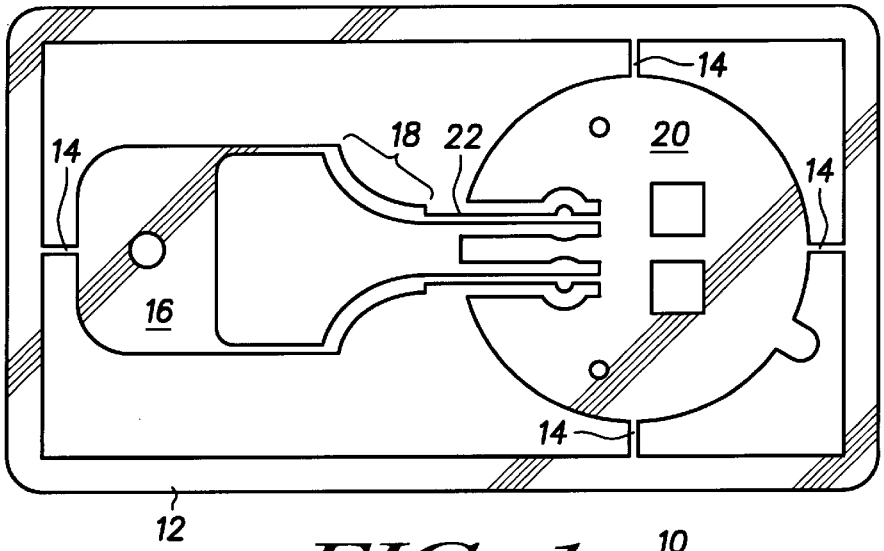
FIG. 1 is a top view of a lead frame in accordance with one embodiment of the present invention.

FIG. 1 is a top view of a lead frame 10 that is used in one embodiment of the present invention. In a preferred embodiment, the lead frame 10 is etched or stamped from a piece of conductive material (ordinarily a conductive sheet). The lead frame 10 can also be formed by milling, laser cutting, or any other method that is capable of creating features in sheet materials. The lead frame 10 is preferably formed from a single sheet of conductive material; however, multiple lead frame components can also be used without departing from the spirit and scope of the invention. The thickness of the lead frame sheet material should be enough to provide an adequate amount of rigidity during the manufacturing process. In addition, the lead frame 10 can be plated (such as with nickel or gold plating) to improve solderability and/or conductivity. In the preferred embodiment, the sheet material is beryllium copper having a thickness of between 9 and 11 mils.

With reference to FIG. 1, the lead frame 10 includes: a border portion 12, support tabs 14, a shaping tab 16, arms 22 having probe portions 18, and a back-short portion 20. The border portion 12 is operative for providing stability and structural rigidity to the lead frame 10 during the assembly process. That is, the border portion 12 allows the lead frame 10 to be handled (either by machine or by an assembler) during manufacture without deforming the circuit elements therein. The support tabs 14 connect the operative parts of the lead frame 10 the border portion 12 and are eventually removed during manufacture. The shaping tab 16 is used to shape the probe portions 18 and associated circuitry into a desired shape for use as a waveguide feed.

The probe portions 18 are the parts of the waveguide feed that are used to launch/sense electromagnetic energy within the waveguide. The lead frame can include one or more probe portions 18 for performing this function (depending on, for example, the type of polarization used). The desired shape and position of the probe portion 18 are determined by performing appropriate electromagnetic analyses, as will be apparent to persons of ordinary skill in the art. The electromagnetic analyses can be performed using, for example, a simulation software package such as Ansoft's Eminence. The design needs to take into account, among other things, the radius of the bends that are made to form the probes. In addition, the design needs to be robust enough to account for tolerances in the assembly process, such as tolerances in the dielectric constant of the mold material and the bend accuracy of the lead frame 10.

The back-short portion 20 provides the back ground-wall that is required by the probe portions 18 to achieve a desired electromagnetic response. Accordingly, the distance between the probe portions 18 and the back-short portion 20 is very important.

Figure 2:
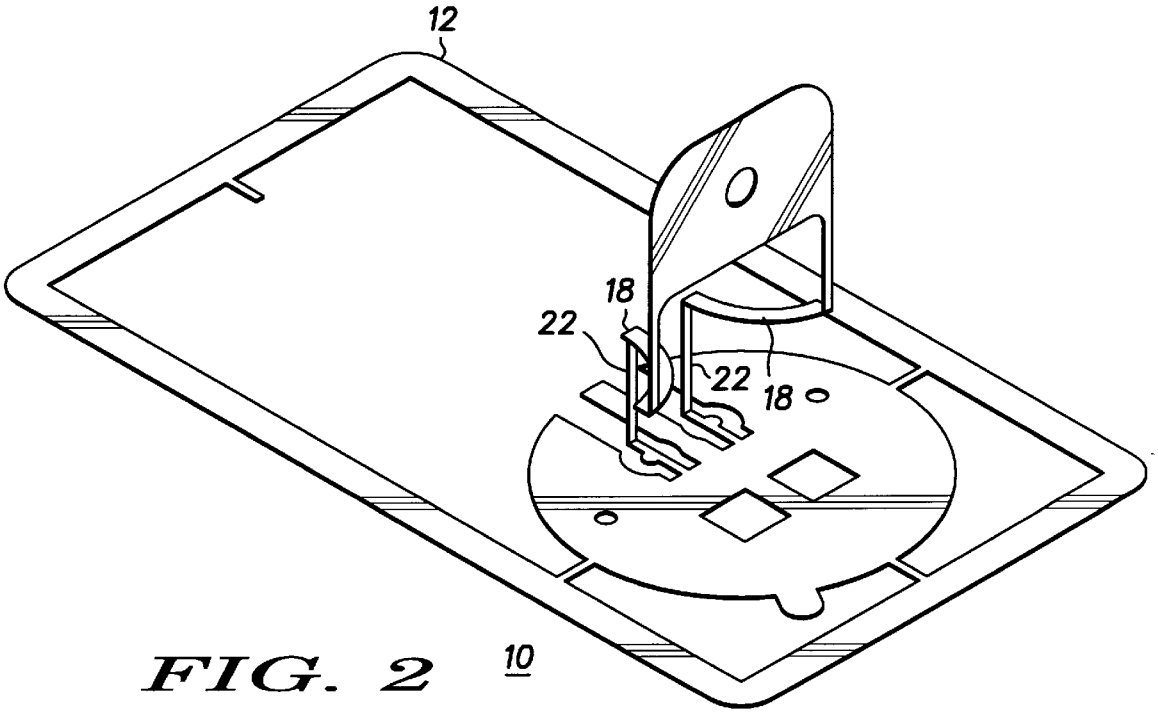
FIG. 2 is an isometric top view of the lead frame of FIG. 1 after probe portions have been shaped in accordance with one embodiment of the present invention.

FIG. 2 is an isometric view of the lead frame 10 after the probe portions 18 have been appropriately shaped. As shown, the arms 22 having the probe portions 18 are bent to a position substantially perpendicular to the plane of the lead frame 10. Additional bends are also provided so that the bulk of the probe portions 18 are approximately parallel to the plane of the lead frame 10. In any particular application, the shape of the probe portions 18 will depend on the underlying electromagnetic analysis. It should be noted that before bending can take place, one of the support tabs 14 must be broken. To enhance the accuracy, repeatability, and speed of the bending process, special bending tools (not shown) can be provided for shaping the probe portions 18. The tools can be for manual or machine use.

After the probe portions 18 have been appropriately shaped, the lead frame 10 is inserted into a mold (not shown). The mold allows a molten or liquid molding material to be poured or injected in and around the shaped probe portions 18 and the associated circuitry. Once the mold material hardens, the probe portions 18 are secured in their proper position with respect to the back-short portion 20. In a preferred embodiment of the present invention, injection molding techniques are used to apply the molding material to the lead frame 10. The injection molding process can be either a single-shot or a multiple-shot process depending upon the flow properties of the dielectric compound and the structural integrity of the formed elements. As the dielectric constant of the molding material can affect, among other things, the effective line lengths of the probe portions 18, the molding material should be chosen before the probe design is performed. In one embodiment of the present invention, Ultem 2110, manufactured by General Electric, is used as the molding material.

Figure 3:
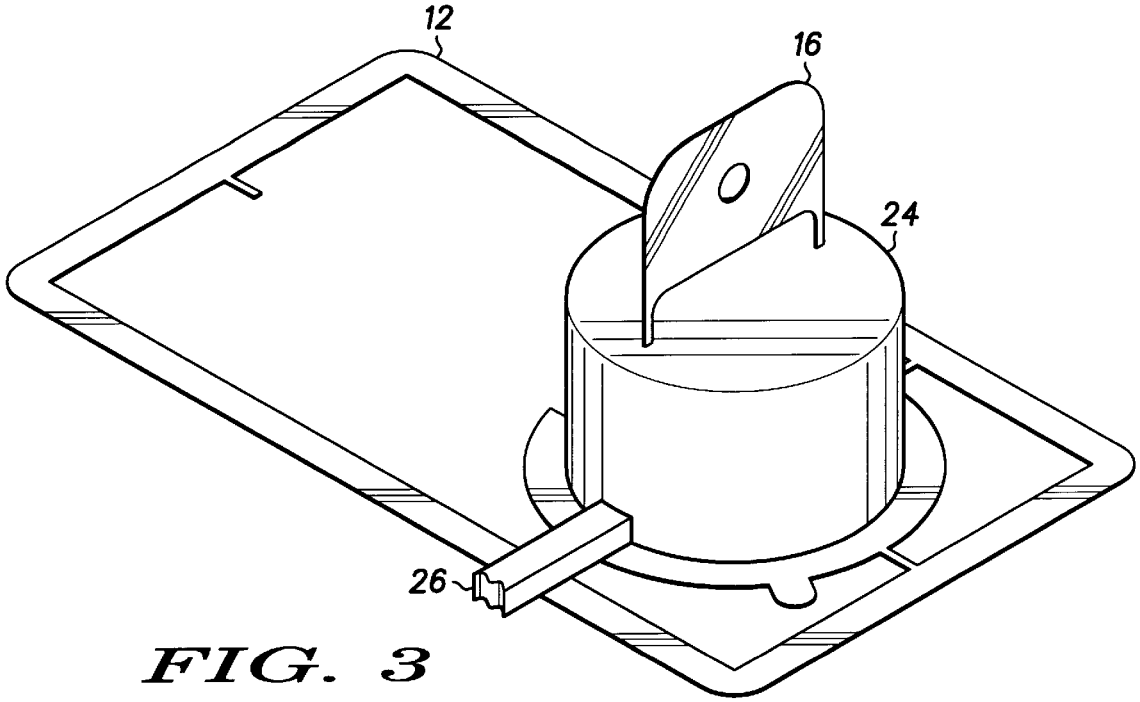
FIG. 3 is an isometric top view of the lead frame of FIG. 1 after portions have been molded in accordance with one embodiment of the present invention.

FIG. 3 is an isometric top view of the lead frame assembly after molding has occurred. As shown, the probe portions 18 and related circuitry are completely encapsulated in the solidified dielectric molding material 24 that was poured/injected into the mold. In a preferred embodiment of the invention, the outer shape and dimensions of the solidified dielectric molding material 24 will be tailored for the particular application. For example, the solidified dielectric molding material 24 of FIG. 3 has a cylindrical outer shape for insertion into a circular waveguide (and is referred to as a "dielectric puck"). In a preferred embodiment, an outer dimension (e.g., the external diameter) of the dielectric puck is made slightly smaller than an internal dimension (e.g., the inner diameter) of the circular waveguide for easy insertion. The dielectric puck is then held in place in the circular waveguide by a printed circuit board that is connected to the underside of the waveguide feed and secured to the waveguide. In an alternate embodiment, the dimensions of the dielectric puck are chosen to form a compression fit in the circular waveguide, thereby dispensing with the need for additional fastening means to secure the feed in the waveguide. Preferably, the dielectric molding material 24 fully fills an area between the shaped probe portions 18 and the back-short portion 20 to hold the probe portions 18 in fixed relation with respect to the back-short portion 20 during operation.

Figure 4:
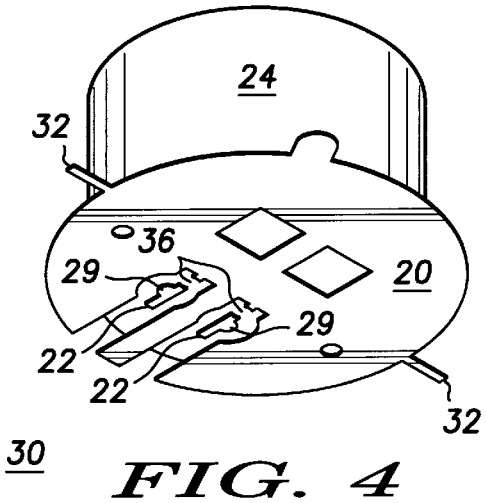
FIG. 4 is an isometric bottom view of the lead frame of FIG. 1 after a shaping tab and a residual strip of dielectric material have been excised in accordance with one embodiment of the present invention.

With reference to FIG. 3, it should be noted that the shaping tab 16 protrudes out of the top of the solidified dielectric molding material 24 after molding. In addition, a residual strip 26 of dielectric molding material still remains in the area where the molding material was originally poured/injected into the mold. The shaping tab 16 and the residual strip 26 of dielectric molding material are excised after molding is completed. After these elements have been removed, the remaining support tabs 14 are severed and the border portion 12 is discarded. FIG. 4 is an isometric bottom view illustrating the underside of the resulting waveguide feed 30. It should be noted that tab portions 32 of two of the support tabs 14 have been left on the sides of the waveguide feed 30. These tab portions 32 can be used to secure a connector or a printed circuit board (PCB) to the underside of the waveguide feed 30.

Before the waveguide feed 30 can be used, all electrical continuity between the probe portions 18 and the back-short portion 20 must be severed. In a preferred embodiment of the invention, this is performed by drilling holes through the arms 22 in a location where the arms 22 connect to the body of the back-short portion 20. As illustrated in FIG. 4, holes 36 have been drilled to sever the arms 22 from the back-short portion 20. Naturally, the holes 36 are of a diameter that is greater than the width of the arms 22 to completely sever the electrical connection. Other severing methods, such as etching or slicing with a blade, can also be used. Whichever method is used, care should be taken to ensure that the ends of the arms 22 are accessible from the underside of the waveguide feed 30, as the ends of the arms 22 form terminal points for the connection of external circuitry to the waveguide feed 30. As shown in FIG. 4, solder pads 29, can be provided for facilitating access to the probes. In one embodiment, interconnects are molded into the waveguide feed so that no additional parts are required to interface with external "off the shelf" packages.

As described above, the back-short portion 20 acts as a ground plane for the probes in the waveguide feed 30. In one embodiment of the present invention, external circuitry is mounted to the lower surface of the back-short portion 20. For example, a printed circuit board (PCB) or chip carrier can be mounted to the lower surface and can use the back-short portion 20 as a ground plane. The PCB can include processing circuitry for processing signals received from and/or delivered to the waveguide feed 30. In addition or alternatively, a connector can be mounted on the lower surface of the back-short portion 20 for use in coupling the waveguide feed 30 to an external transmission line. In one embodiment of the invention, the connector, chip carrier, and/or PCB is injection molded in fixed relation to the back-short portion 20. To reduce assembly time, this injection molding can be performed during the same injection molding step that encapsulates the probe portions 18.

Figure 5:
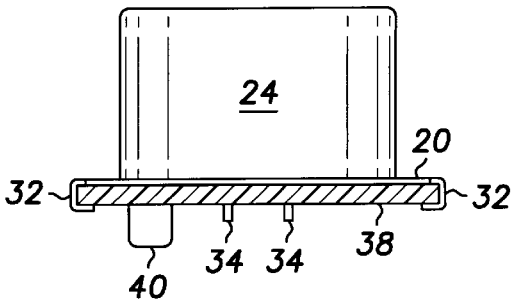
FIG. 5 is a side view of a waveguide feed in accordance with one embodiment of the present invention.

Virtually any type of external transmission line can be coupled to the waveguide feed 30. All that is required is an appropriate transition between the terminal points formed by the ends of the arms 22 and the external transmission line. In one embodiment of the invention, a mechanical/electrical interconnect is provided. In another embodiment, as illustrated in FIG. 5, a soldered transition is provided to a microstrip transmission line. Perpendicular feed pins 34 are first attached to each of the solder pads 29. A PCB 38 having two appropriately located through holes (not shown) is then placed over the feed pins 34 and secured to the underside of the back-short portion 20. The PCB 38 can be secured to the back-short portion 20 using the tab portions 32, as described above. The feed pins 34 are then soldered to microstrip traces (not shown) on the lower surface of the PCB 38. The microstrip traces can then carry signals to/from electronic circuitry 40 also located on the PCB 38. Transitions to other types of transmission lines are also possible as will be apparent to persons of ordinary skill in the art.

Figure 6:
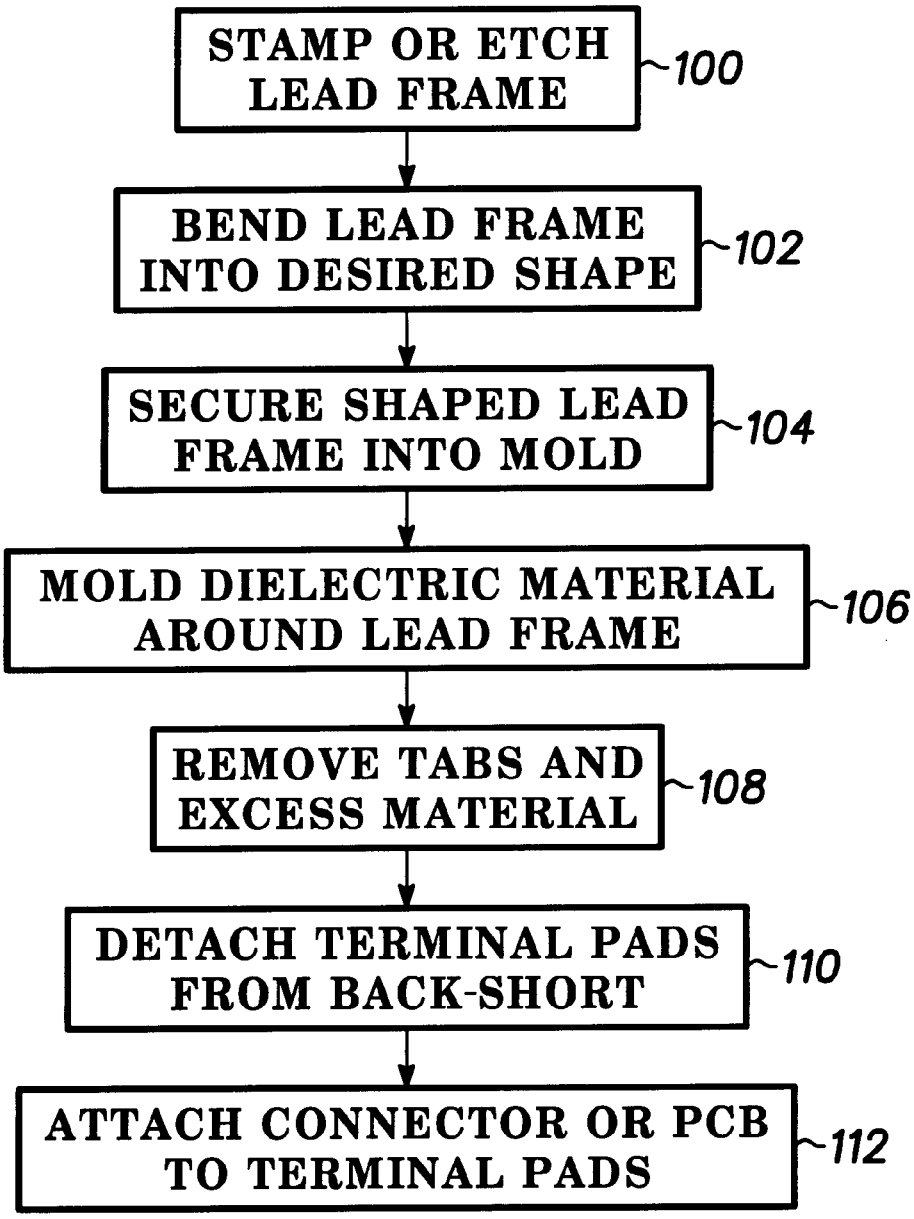
FIG. 6 is a flowchart illustrating a method of manufacturing a waveguide feed in accordance with one embodiment of the present invention.

FIG. 6 is a flow chart illustrating a method for manufacturing a waveguide feed in accordance with one embodiment of the present invention. First, a lead frame is created by stamping, etching, or similar process (step 100). Then, the lead frame is bent into a desired shape (step 102). The shaped lead frame is then secured within a mold (step 104) and mold material is injected or poured into the mold around relevant portions of the lead frame (step 106). The lead frame is then removed from the mold and the tabs and excess molding material are excised (step 108). The terminal pads are then severed from the back-short (step 110) and a connector, PCB, and/or chip carrier is attached to the terminal pads (step 112).

It should be appreciated that the present invention is not limited to the manufacture of one waveguide feed at a time. That is, multiple feeds can be molded in the same injection molding process, preferably using a one-shot injection. This requires a lead frame having an appropriate number of individual elements to produce the multiple feeds. The lead frame can be shaped in a single bending step for all of the feeds. In addition, a mold is required that can direct mold material to multiple feeds from, preferably, a single injector input. By producing multiple feeds in a single-shot process, manufacturing times and production costs can be reduced considerably.

What is claimed is:

1. A waveguide feed apparatus for providing a transition into/out of a waveguide, comprising:

a conductive arm having a probe portion that is capable of sensing/radiating electromagnetic energy within the waveguide, said conductive arm having a predetermined shape;

a dielectric material encapsulating said conductive arm and maintaining said conductive arm in said predetermined shape;

a conductive back-short portion coupled to said dielectric material and forming a back-short for said probe portion;

said dielectric material holds said probe portion in fixed relation to said conductive back-short portion; and said conductive back-short portion and said conductive arm are both formed from a single sheet of conductive material.

2. The waveguide feed apparatus, as claimed in claim 1, wherein:

said dielectric material is injection molded about said conductive arm.

3. The waveguide feed apparatus, as claimed in claim 1, wherein:

said conductive arm is formed from a single sheet of conductive material and is bent into said predetermined shape.

4. The waveguide feed apparatus, as claimed in claim 1, wherein:

said single sheet of conductive material is formed into a lead frame.

5. The waveguide feed apparatus, as claimed in claim 1, wherein:

said dielectric material includes an outer dimension that is tailored to an internal dimension of the waveguide.

6. The waveguide feed apparatus, as claimed in claim 1, wherein:

said dielectric material has a cylindrical outer shape.

7. A waveguide feed apparatus, comprising:

at least one probe portion for use in radiatingl/sensing electromagnetic energy within a waveguide; and a back-short portion for providing an electrical back-short for said at least one probe portion, said back-short portion being conductively isolated from said at least one probe portion;

wherein an area between said back-short portion and said at least one probe portion is at least partially filled with a dielectric molding material so that said at least one probe portion is held in fixed relation to said back-short portion; and said at least one probe portion and said back-short portion are formed from a single sheet of conductive material.

8. The waveguide feed apparatus, as claimed in claim 7, wherein:

said dielectric molding material is injection molded into said area.

9. The waveguide feed apparatus, as claimed in claim 7, wherein:

said at least one probe portion and said back-short portion are conductively coupled to one another when initially formed.

* * * * *